US007748496B2

(12) United States Patent
Higgins et al.

(10) Patent No.: US 7,748,496 B2
(45) Date of Patent: Jul. 6, 2010

(54) AERIAL WORK PLATFORM ASSEMBLY USING COMPOSITE MATERIALS

(75) Inventors: Daniel Higgins, Raleigh, NC (US); Ryan McKinney, Mooresville, NC (US)

(73) Assignee: Altec Industries, Inc., Birmingham, AL (US)

( * ) Notice: Subject to any disclaimer, the term of this patent is extended or adjusted under 35 U.S.C. 154(b) by 792 days.

(21) Appl. No.: 11/055,346

(22) Filed: Feb. 10, 2005

(65) Prior Publication Data

US 2006/0175127 A1 Aug. 10, 2006

(51) Int. Cl.
*B66F 11/04* (2006.01)

(52) U.S. Cl. ..... 182/2.4; 182/2.1; 182/2.2; 182/2.3; 182/2.11

(58) Field of Classification Search ..... 182/2.1, 182/141, 142, 150, 2.4
See application file for complete search history.

(56) References Cited

U.S. PATENT DOCUMENTS 3,087,581 A * 4/1963 Pitman ..... 182/2.4
3,139,948 A * 7/1964 Rorden ..... 182/2.4
3,146,853 A * 9/1964 Eckels ..... 182/46
3,233,700 A * 2/1966 Myers ..... 182/2.4
3,295,633 A * 1/1967 Milner, Jr. ..... 182/222
3,302,963 A * 2/1967 Rochfort ..... 403/11
3,380,554 A * 4/1968 Duryee ..... 182/46
3,554,319 A * 1/1971 Smith et al. ..... 182/46
3,590,948 A * 7/1971 Milner, Jr. ..... 182/2.1
3,917,026 A * 11/1975 Hedges ..... 182/129
4,044,856 A * 8/1977 Stevenson ..... 182/2.4
4,334,594 A * 6/1982 Jost ..... 182/2.1
4,553,632 A * 11/1985 Griffiths ..... 182/2.4
4,742,890 A * 5/1988 de Blauw ..... 182/222
4,763,755 A * 8/1988 Murray ..... 182/2.2
4,784,278 A * 11/1988 Luscombe ..... 212/292
5,016,731 A * 5/1991 Holmes ..... 182/2.8
5,076,449 A * 12/1991 Clutter ..... 212/283
5,560,730 A * 10/1996 Gillard et al. ..... 403/294
5,944,138 A * 8/1999 Vollmer et al. ..... 182/2.1
6,105,723 A * 8/2000 D'Alessio ..... 182/222
6,131,700 A * 10/2000 Farner ..... 182/222
6,170,607 B1 * 1/2001 Freeman et al. ..... 182/18

* cited by examiner

*Primary Examiner*—Katherine W Mitchell
*Assistant Examiner*—Colleen M Quinn
(74) *Attorney, Agent, or Firm*—Triangle Patents

(57) ABSTRACT

An aerial work platform assembly is provided, comprising a platform shaft retaining assembly; a mounting bracket connected to the platform shaft retaining assembly; and a platform connected to the mounting bracket; wherein the platform shaft retaining assembly, mounting bracket, and platform are constructed from the same or differing composite materials comprising a fabric-reinforced resin. Optionally, the fabric-reinforced resin includes a preform fabric having a conformable three-dimensional weave, and the resin is a dielectric resin selected from either epoxy, epoxy vinyl ester, vinyl ester, polyester, or phenolic.

14 Claims, 6 Drawing Sheets

AERIAL WORK PLATFORM ASSEMBLY USING COMPOSITE MATERIALS

BACKGROUND OF THE INVENTION

I. Field of the Invention

The present invention relates generally to vehicle-mounted aerial devices, and more particularly to structural components of such devices which are constructed from dielectric composite materials.

II. Background and Prior Art

Vehicle mounted aerial devices have long been used for a variety of applications such as performing work on utility poles, trimming trees, maintaining street lights, and servicing overhead power and telephone lines. The aerial device normally includes a multiple-section boom which can either be an articulating boom or a boom that is extensible and retractable in telescoping fashion. The end of the upper boom is equipped with a personnel carrying device which is typically a platform, sometimes called a "bucket." The aerial work platform assembly consists of: the mounting brackets, platform, jib, the control assembly, control input mechanism and all other components at the end of the upper boom. This assembly is commonly referred to as the "boom tip" More than one platform may be attached to the end of the upper boom, and a platform may be large enough to carry one or more workers. Supplemental load lifting devices may also be installed on the boom near the platform in order to provide the aerial device with material lifting capabilities, in addition to its personnel lifting feature. The load lifting device is typically an adjustable jib, a winch, or a combination of both.

Typically, an aerial device broadly comprises a platform which serves as a work station for the operator; a movable boom; a vehicular base, such as a truck; a control input mechanism; and a control assembly. The platform is operable to lift or otherwise carry at least one worker to the elevated work site, and is coupled with the boom at or near a distal end thereof. Because the platform may be used near highly-charged electrical lines or devices, the platform is typically electrically isolated from the ground through the insulated booms and vehicle base so as to provide secondary protection against damaging electrical discharge or electrocution of the worker or bystanders. One component in isolating the platform occupant from ground through the booms and vehicular base is a non-conductive platform liner which provides some electrical isolation for the occupants lower extremities, as long as the lower extremities are contained entirely within the liner and in contact with nothing other than the liner.

The booms are movable so as to elevate and otherwise position the platform where desired, and are coupled with the vehicular base at or near a base end of the lower boom which is substantially opposite the distal end. The upper boom is constructed of an electrically non-conductive, or dielectric, material and provides secondary protection by preventing a path to ground through the booms and vehicular base. Commonly, in order to further electrically isolate the platform from electrical discharge via the boom and the vehicular base, an intermediate portion or section of the lower boom is constructed of or covered with an electrically non-conductive, or dielectric, material. The distal end of the boom or boom tip however, though electrically isolated from the vehicular platform, must incorporate structural material so as to have sufficient structural strength to support the platform and worker. This structural material is typically an electrically conductive metal, such as steel, with the steel, platform and control assembly being considered electrically connected. In addition to the boom assembly, various other parts at the end of boom are constructed from metals such as steel or aluminum and all components at the end of the boom must be considered electrically connected. The vehicular base is motorized and wheeled or otherwise adapted to quickly and efficiently travel to and from the work site. The vehicular base will either be in direct contact with an electrical ground, such as, for example, the Earth, or must be considered in direct or indirect contact therewith.

The control input mechanism allows the elevated worker to provide a control input to control, via the control assembly, movement of the boom and positioning of the platform. Commonly, the control assembly comprises one or more hydraulic control valves, one or more fluid conduits and a quantity of hydraulic fluid, to transmit the control input down the boom for implementation. The necessary conduit connections, however, prevent the control valves from being located inside the platform and its protective liner. Furthermore, as the control input mechanism must be in direct physical contact with the control assembly in order to actuate the valves in accordance with the control input, the control input mechanism must also be located outside the platform and protective liner. Thus, the worker may reach outside the protective liner to actuate the control input mechanism, thereby exposing him or herself to possible electrocution if they are working in the area of energized lines, contrary to federal safety regulations and employer safe practices. The control valves to which the control input mechanism is coupled are typically constructed of an electrically conductive material. Furthermore, the control valves may be located in close proximity to the aforementioned electrically conductive structural support material used to reinforce the distal end of the boom.

Thus, although the aforementioned dielectric boom portion does protect against electrical discharge via the boom and vehicular base, it does not protect against direct discharge via the electrically conductive structural material in the distal end of the boom, via the control valves, and via the control input mechanism. For example, a discharge path could be from an unprotected first conductor, to any component at the boom tip, to any other component at the boom tip, including the control input mechanism, to a worker not using rubber gloves, and to a second unprotected conductor. It will be appreciated that the dielectric boom portion provides no protection against this or similar discharge paths.

In order to minimize the risks of injury, the operator must always maintain safe clearances from electrical lines in accordance with applicable government regulations, such as those promulgated by the Occupational Safety and Health Agency (OSHA), and safe work practices adopted by the employer. Furthermore, if the possibility of electrical contact or proximity exists, operators must use proper protective equipment which provides primary protection from electrical injury. The aerial device will not provide protection from contact with or proximity to an electrically charged power line when the operator or the components at the boom tip are in contact with or in proximity to another power line, ground, or pole. If such contact or proximity occurs, all components at the boom tip, including the controls, may become energized. It should be understood that no invention will completely prevent electrical accidents. However, the present invention may provide greater protection than existing designs against electrical injury sustained by a worker whose behavior does not conform to government regulations and safe work practices.

Therefore due to advances in technology and newly available materials, an opportunity now exists for an improved aerial work platform assembly that may better protect the worker against electrical discharge when regulations and safe practices are not followed. While various non-metals, such as rubber, plastic, and polymer materials might satisfy the dielectric requirement of the components in such an improved system, most of those materials are not suitable. The aerial work platform assembly components must be structurally rigid and durable, but cannot be overly bulky and cumbersome to manipulate. The ideal solution, therefore, is to construct an aerial work platform assembly that maximizes the number of parts which are lightweight, structurally rigid, durable, and substantially nonconductive, in addition to being more cost effective than the construction of prior art assemblies. From the description that follows, it will be seen that the present invention accomplishes all of these objectives.

SUMMARY OF THE INVENTION

Therefore, one object of the present invention is to provide an aerial work platform assembly which uses electrically non-conductive composite materials.

It is also an object of the present invention to provide an aerial work platform assembly which replaces a maximum of metal parts in the assembly to reduce or eliminate electrical conductivity.

A further object of the present invention is to provide an aerial work platform assembly which is lighter in weight than conventional designs.

Another object of the present invention is to provide an aerial work platform assembly which maintains the desired structural integrity and reduces manufacturing and maintenance costs.

Accordingly, an aerial work platform assembly is provided, comprising a platform shaft retaining assembly; a mounting bracket connected to the platform shaft retaining assembly; and a platform connected to the mounting bracket; wherein the platform shaft retaining assembly, mounting bracket, and platform are constructed from the same or differing composite materials comprising a fabric-reinforced resin. Optionally, the fabric-reinforced resin includes a preform fabric having a conformable three-dimensional weave, and the resin is a dielectric resin selected from either epoxy, epoxy vinyl ester, vinyl ester, polyester, and phenolic.

DETAILED DESCRIPTION OF THE PREFERRED EMBODIMENTS

Certain features which are used in assembling or operating the invention, but which are known to those of ordinary skill in the art and not bearing upon points of novelty, such as screws, bolts, nuts, welds, and other common fasteners, may not be shown for clarity. In order to appreciate the novelty of the present invention and its improvements over prior designs, a detailed description of the existing art is provided first with reference to FIGS. 1 and 2, followed by a description of various embodiments of the invention. The following description focuses on one prior art configuration, particularly an over-center machine with an articulation linkage, with the understanding that many other variations of prior art aerial configurations may be equally suitable for use with the invention.

I. Existing Designs for Aerial Devices

Figure 1:
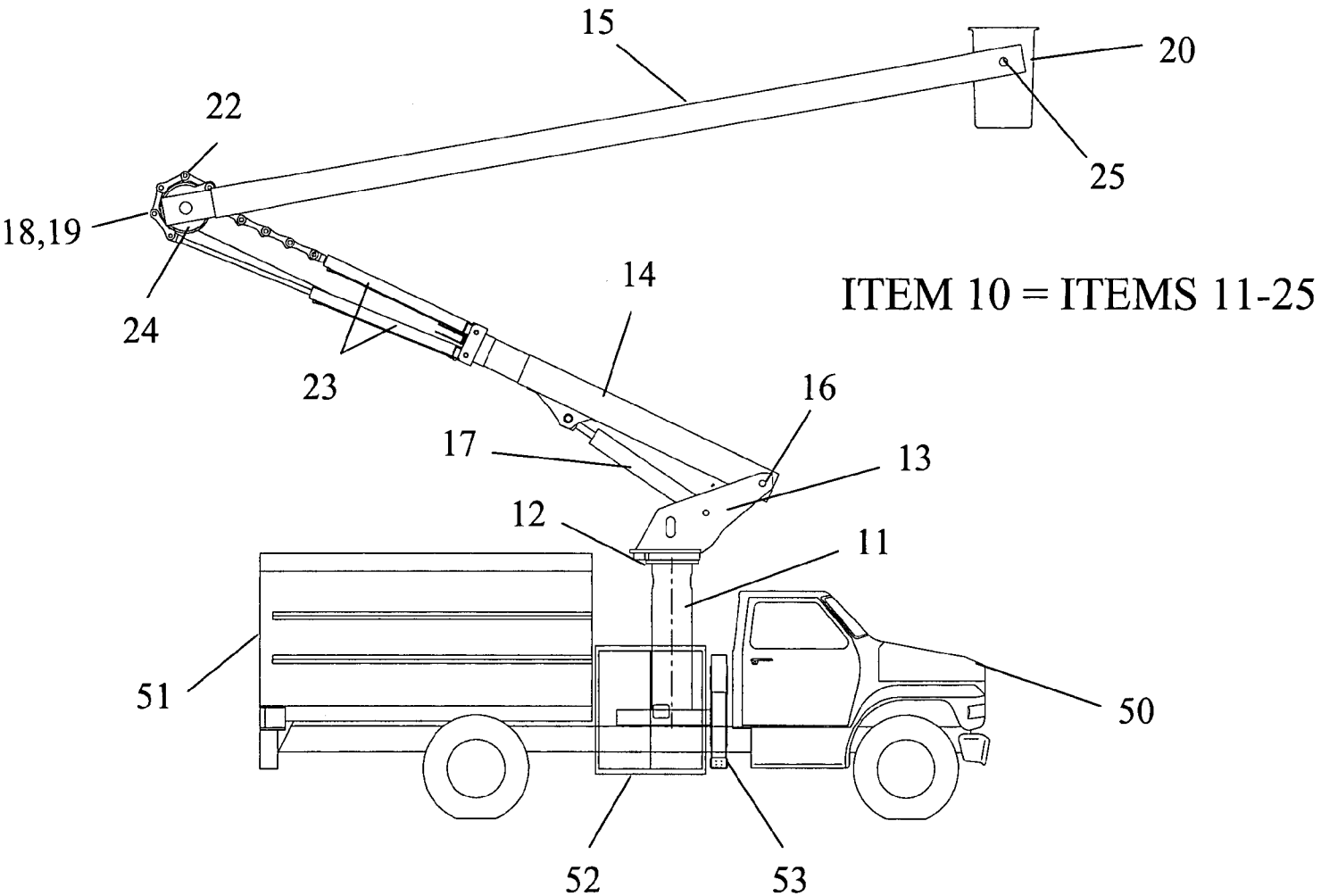
FIG. 1 is an elevation view of a conventional aerial device depicting a vehicle, turntable, boom assembly, and platform.

Referring now to the drawings in more detail and specifically to FIG. 1, an articulating aerial device assembly 10 known in the prior art is mounted in the bed of a utility vehicle 50. A stationary pedestal 11 is mounted in the vehicle bed immediately behind the cab. Mounted for rotation on pedestal 11 is a rotation system 12 which supports a turntable 13. The turntable 13 can be rotated by a drive motor (not shown) about a vertical axis of rotation in order to rotate the aerial device 10 to various positions. Depending upon the specific function of the equipment, the vehicle 50 may also contain a chip box 51 and body bins 52.

The aerial device includes an articulating boom assembly formed by a lower boom 14 and an upper boom 15. The bottom end of the lower boom 14 is pivotally connected with the turntable 13 by a horizontal pin at the lower boom pivot 16. Lower boom 14 may be pivoted up and down about the axis of the lower boom pivot 16 by a hydraulic cylinder 17 having its base end pivoted to the turntable 13 and its rod end pivoted to a bracket on the lower boom 14.

The top end of the lower boom 14 is pivotally connected with the bottom end of the upper boom 15 at an articulated joint or elbow 18. A horizontal pivot shaft 19 forms a pivot axis about which the upper boom 15 can be articulated relative to the lower boom. Movement of the upper boom 15 relative to the lower boom 14 is accomplished by a drive link 22 operated by upper boom cylinders 23. The drive link 22 is engaged by a upper boom drive weldment 24, which functions as a sprocket, affixed to the base of upper boom 15, such that movement of the drive link 22 causes rotation of the upper boom drive weldment 24 and articulation of the upper boom 15. Preferably, the upper boom 15 can pivot through a large angle of articulation relative to the lower boom 14. In a preferred form of the present invention, this angle of articulation is well beyond 180 degrees and may approach 360 degrees. Further details of the articulating aerial device 10 and boom assembly are described in U.S. Pat. No. 4,602,462, the disclosure of which is incorporated herein by reference. At its top end or platform shaft retaining assembly 25, the upper boom 15 carries one or more platforms 20. A conventional leveling system (not shown) operates to maintain the platform 20 level to the ground at all positions of the lower and upper booms 14, 15.

The aerial device 10 has a storage position in which the lower and upper booms 14, 15 are side by side and horizontal. In the storage position, the lower boom 14 is lowered onto the truck 50. The upper boom 15 is lowered to a zero angle of articulation and rests on an upper boom rest (not shown) mounted on one side of the turntable 13. Optionally, a cab guard (not shown) may extend over the top of the cab to provide a convenient surface from which workers can enter or exit from the platform 20.

Figure 2:
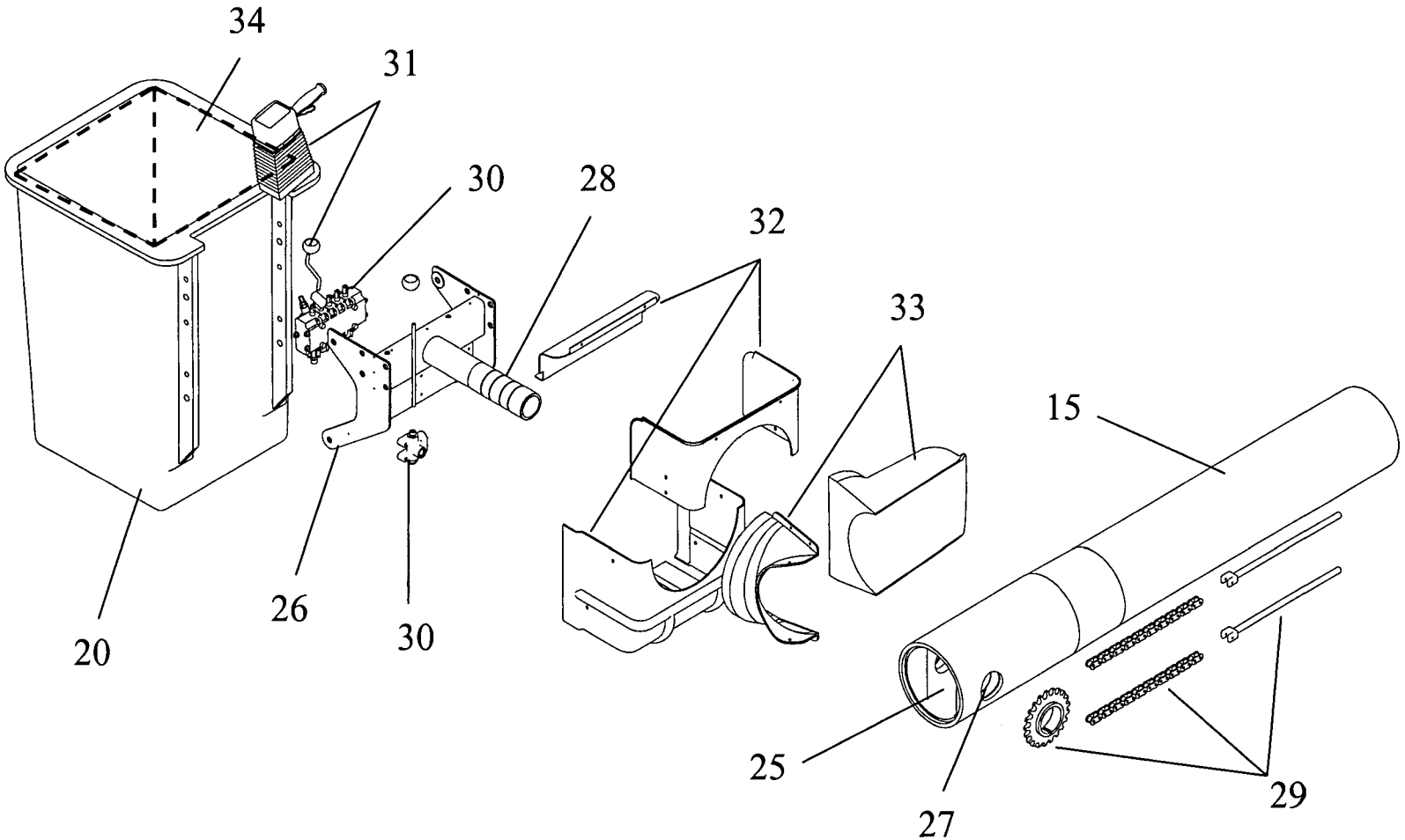
FIG. 2 is an exploded view of a prior art aerial work platform assembly.

FIG. 2 provides an exploded view of a prior art aerial work platform assembly generally having a platform shaft retaining assembly 25 affixed to upper boom 15, a mounting bracket 26, and a platform 20. The platform shaft retaining assembly 25 is typically constructed of steel or aluminum and contains bearings 27 which rotatably support a steel shaft 28 extending from a mounting bracket 26. Leveling system 29, comprised typically of a chain and sprocket system, is operatively connected to shaft 28 within platform shaft retaining assembly 25 to maintain the platform 20 level to the ground during use. One example of such a leveling system 29 is described in U.S. Pat. No. 5,944,138. the disclosure of which is incorporated herein by reference. Platform 20 is typically constructed from a fiberglass material and is connected to mounting bracket 26 by bolts or pins through the appropriate mating holes. Hydraulic control valves 30 and tool ports are attached, preferably by bolting, to the platform mounting bracket 26. Control handles 31 are connected to the hydraulic control valves 30 in a manner well known in the art, along with hydraulic hoses (not shown) which provide the hydraulic oil flow to and from the valves 30 to operate the upper and lower boom cylinders 17, 23. Various platform covers 32 are constructed from ABS plastic and are designed and positioned to shield the various metal components, such as the mounting bracket 26 and control valves 30, from contact with external objects. The mounting bracket 26 may also include a lanyard connection eyelet (not shown) to which workers may connect a safety lanyard while they are in the platform 20. As previously mentioned, the platform 20 usually requires a removable insulated liner 34 in order to provide a secondary layer of protection to the worker in the event an unexpected contact with unguarded electrical lines should occur. Note that the platform shaft retaining assembly 25 in FIG. 2 is designed to be reversible, such that the platform 20 and mounting bracket 26 may be installed on either side of the platform shaft retaining assembly 25, depending on the specific requirements at the time.

II. Preferred Composite Materials

As can be appreciated from the foregoing description of the prior art, the use of metal components is extensive. Replacement of such parts with dielectric composite materials would provide many advantages. For example, composite materials are typically lightweight in comparison to steel. Lighter components require less counterweight at the vehicle, enable greater side reach of the boom and platform, and allow more capacity in the platform for workers and tools. Also, any reduction in weight would permit a size reduction in the leveling system and other mechanical systems, further saving production costs. Composite materials can be designed to be nonconductive, which would substantially reduce or eliminate potential electrical current paths within the aerial work platform assembly. Moreover, any covers that are required may possibly be designed as an integral part of the structural members employed in the improved assembly. Finally, required maintenance of parts is reduced due to the fact that composite parts do not rust.

However, there are a number of possible disadvantages to the use of composite materials. First, conservative engineering practice requires implementation of higher design safety factors than those associated with the use of ductile materials. Second, composite materials may require more complex part designs when trying to design complete components, as opposed to the simplicity of welding various metal parts to serve the same purpose. Further, the costs of composite materials, in terms of tool costs and ultimate part costs, are generally higher than steel. Finally, employment of composite materials to systems which have traditionally been constructed from steel and aluminum may be resisted by industries and customers which are slow to change from traditional methods and materials.

Figures 4A, 4B:
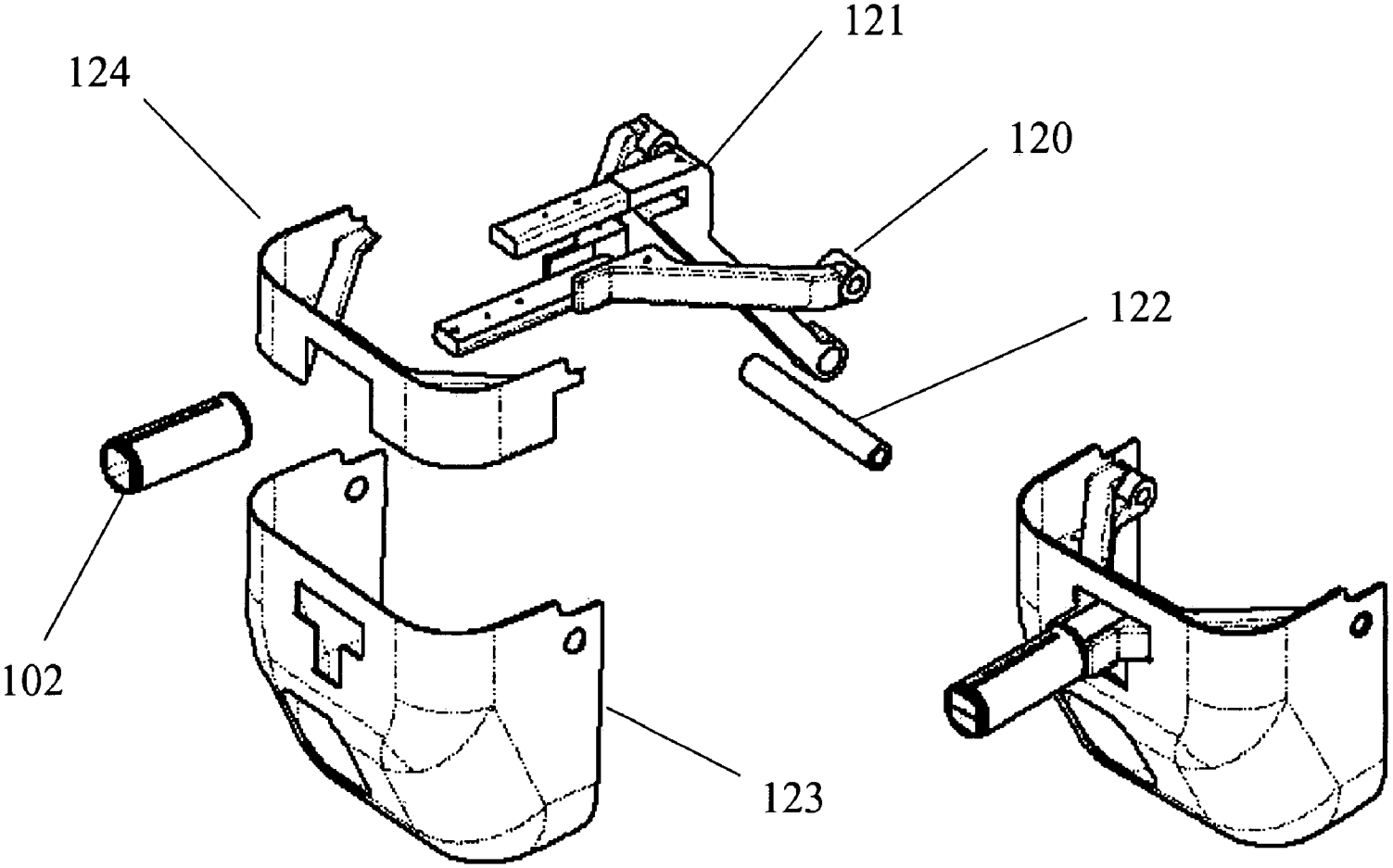
FIGS. 4A and 4B are detail views of the mounting bracket subassembly.
Figure 5A:
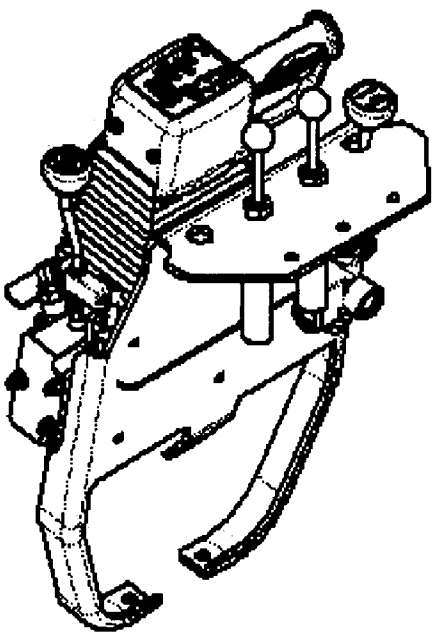
FIGS. 5A and 5B are detail views of the valve bracket assembly and its construction.
Figure 5B:
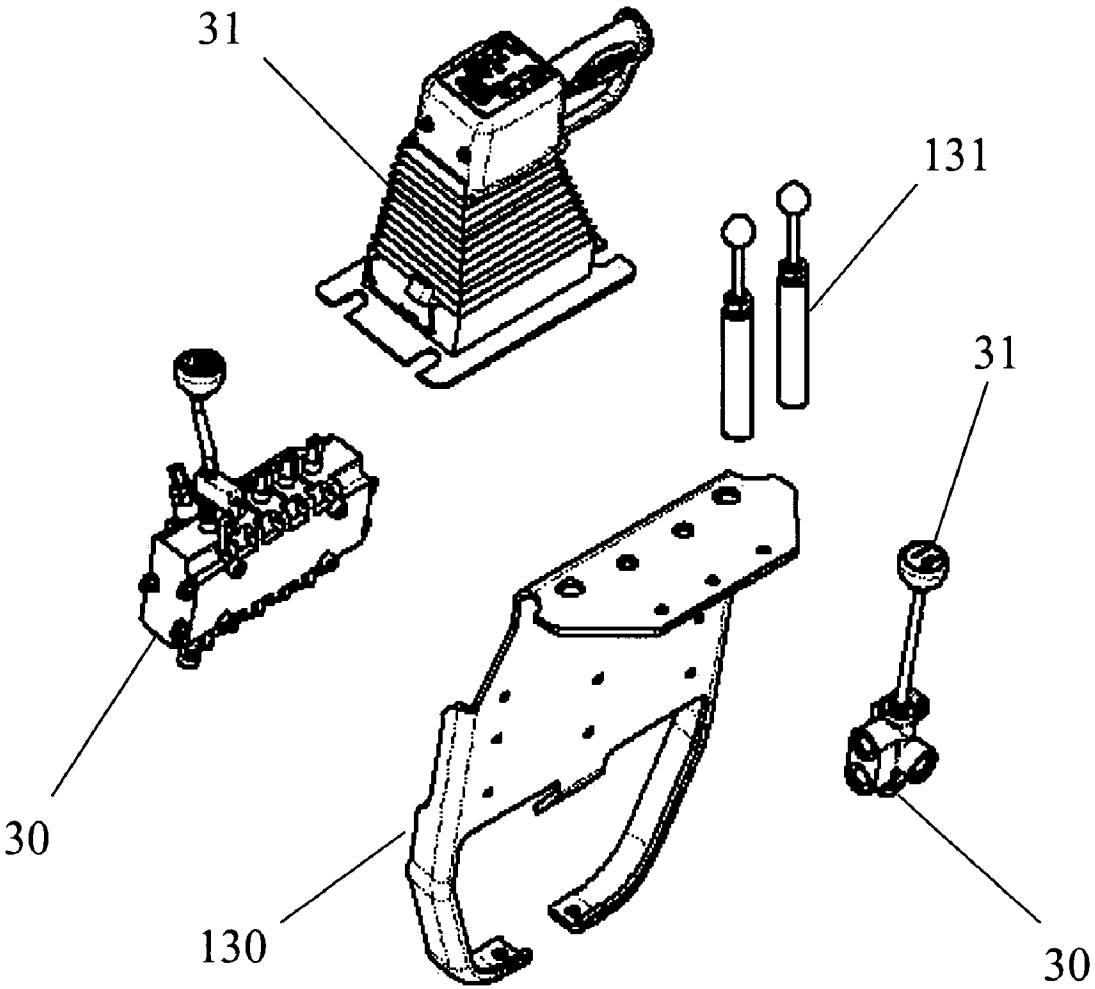
Figure 6:
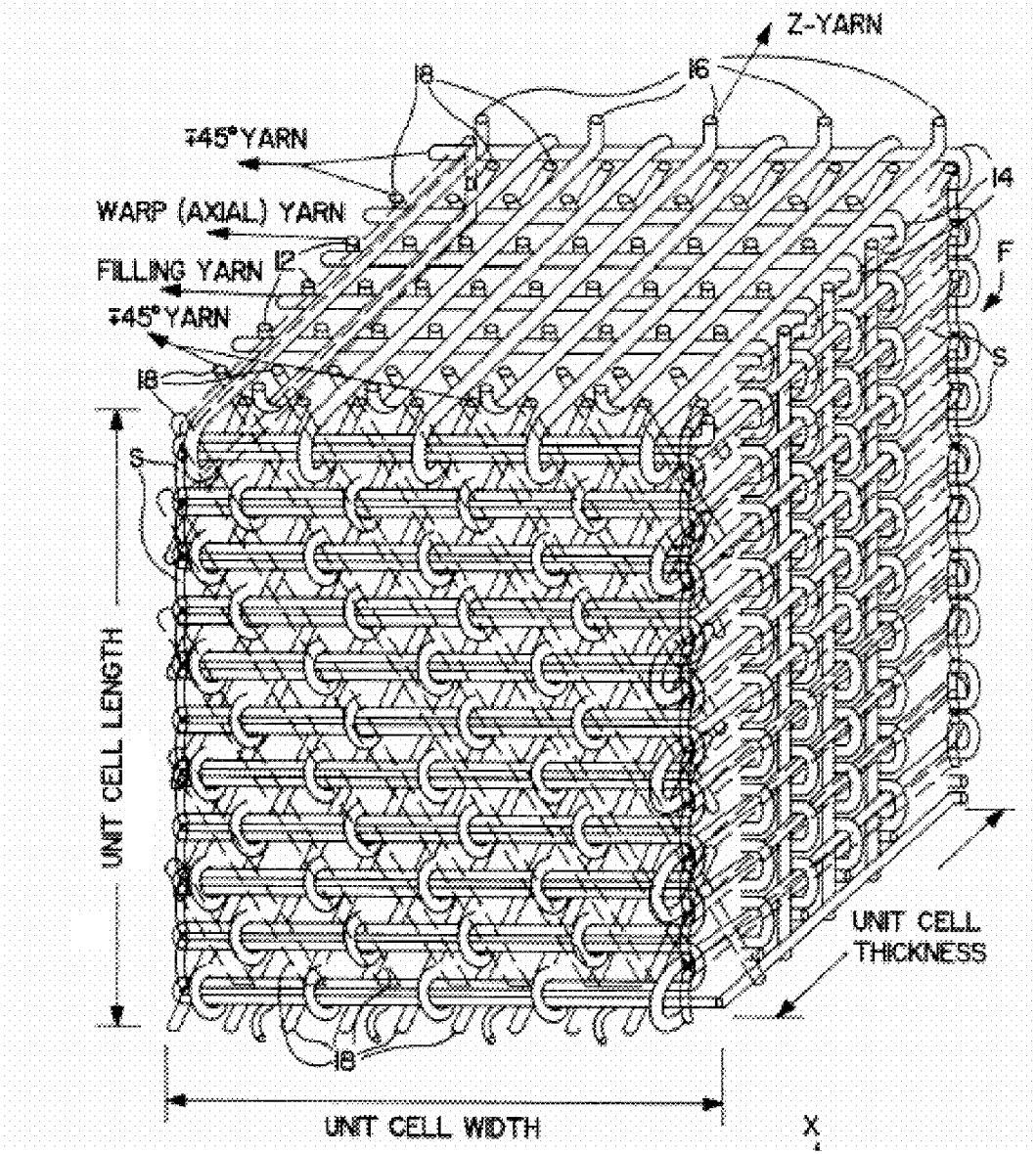
FIG. 6 shows a magnified view of the preform material used in the components, as in FIG. 4B item 123.

By way of example, FIG. 6 shows a magnified view of the preform material used in the components, as in FIG. 4B item 123. It illustrates one embodiment of a 3-D unitarily and integrally formed preform fabric, as set forth in U.S. Pat. No. 5,465,760, FIG. 1, which was incorporated by reference into the detailed description of the present invention hereinabove. The 3-D unitarily and integrally formed fabric preform constructed by three (3) independent, interlacing non-crimped yarn systems, the preform providing for no delamination of the composite formed therefrom, is critical to the redesign of the various components as claimed.

Nevertheless, the inventors herein have determined that certain preferred composite materials provide a superior combination of advantages when used in the fabrication of aerial work platform assembly components. As is known in the art, most "traditional" fiber-reinforced composites consist of a reinforcing fiber, such as fiberglass or Kevlar® and a surrounding matrix of polyester or epoxy resin. Those materials are normally formed by laminating several layers of textile fabric, by filament winding, or by cross laying of tapes of continuous filament fibers. However, those traditional laminated structures often suffer from a tendency toward delamination and ultimate failure. Consequently, efforts have been made to develop three-dimensional braided, woven, or knitted "preforms" as a solution to the delamination problems inherent in laminated composite structures. For example, U.S. Pat. Nos. 5,085,252 and 5,465,760, both of which are incorporated herein by reference, describe methods of forming variable cross-sectional shaped and multi-layer three-dimensional fabrics. Products embodying those methods are marketed under the trademarks "3WEAVE™" and "3BRAID™" by 3TEX, Inc., at http://www.3tex.com. When these types of preforms are used with various known resins, mechanical properties such as flexure (stiffness), tensile strength, compression strength, shear and others can be controlled. Moreover, in the experience of the inventors, the use of preforms which embody such three-dimensional weaving methods provides more advantageous mechanical properties than the use of knitted fabric or woven roving, particularly with the non-conductive resins used, namely the resin marketed under the trademark Hydrex® by Reichhold Chemicals, Inc. The braided preforms, namely 3TEX's 3BRAID™ and 3WEAVE™ materials, have been found particularly suitable to the molding of parts which are complex and require a high degree of conformability and permeability of the fabric, as will be evident from the following description of the preferred and alternate embodiments.

III. Present Invention Employing Composite Materials

Figure 3A:
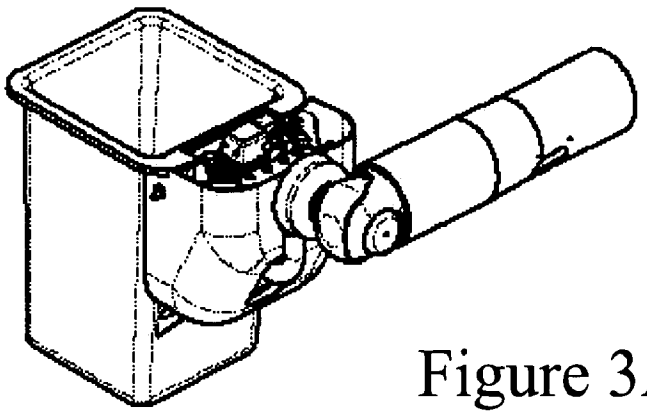
FIGS. 3A and 3B are assembled and exploded views, respectively, of a preferred embodiment of a aerial work platform assembly in accordance with the invention.
Figure 3B:
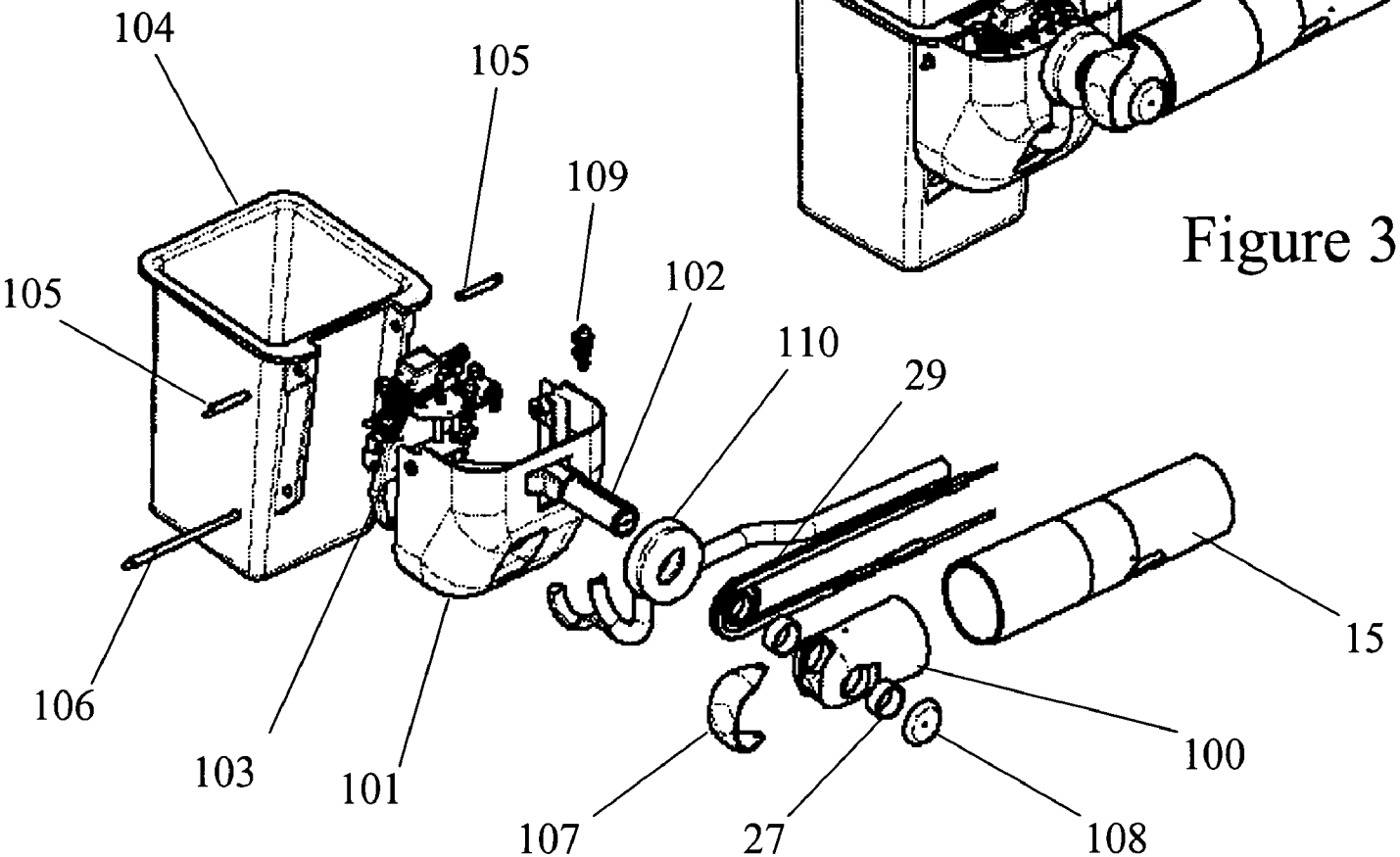

Referring to FIGS. 3A and 3B, assembled and exploded views, respectively, of a preferred embodiment of the invention are illustrated. FIGS. 4A through 5B provide further detailed views of the subassemblies shown in FIGS. 3A and 3B. Although there may appear to be many similarities to the prior art in FIGS. 1 and 2, the present invention departs significantly in the following respects.

First, the invention includes a platform shaft retaining assembly 100 constructed from the braided fiber preform and resin composite described earlier herein, which permits a more feature-rich design. The platform shaft retaining assembly 100 includes two concentric apertures for installation of a pivot shaft 102 extending from a redesigned platform mounting bracket 101. Platform shaft retaining assembly 100 further includes shaft bearings 27 and an end opening for allowing access to the leveling system 29. The end opening is readily covered during operation by an end cover 107.

As depicted more clearly in FIGS. 4A and 4B, mounting bracket 101 is fabricated by bonding two primary composite structures to one another, namely an upper gusset member 120 and a center gusset member 121, using a bonding agent such as methyl methacrylate. Center gusset member 121 and upper gusset member 120 also include horizontal portions to which pivot shaft 102 is bonded. Pivot shaft 102 is constructed from a steel or aluminum cylinder. Center gusset member 121 is also bonded to a lower tube 122 which attaches to a platform 104 by a lower platform pin 106, best shown in FIGS. 3A through 4B. Both upper gusset member 120 and center gusset member 121 are constructed from the aforementioned dielectric composite material whose fibers generally run parallel to the longitudinal axis of each part. Upper gusset member 120 has two horizontal arms that terminate in concentric bosses, through which two upper platform pins 105 are used to mount to the upper portion of platform 104. Platform bracket shroud 123 and platform bracket dashboard 124, as shown in FIG. 4B, are bonded onto the bracket assembly using an agent such as methyl methacrylate.

Platform 104 is also constructed from a composite material comprising a three-dimensional weave preform vacuum-infused with resin. Significantly, because of the superior properties of the composite material, the platform 104 is stronger, lighter, and more rigid than prior designs. Preferably, each of the platform pins 105 and 106 are formed from a composite material as well, further isolating the platform 104 and worker from the possibility of electrocution.

Control valves 30, with their associated control handles 31, are assembled to a valve bracket 103 constructed from the aforementioned dielectric composite material and bolted to platform mounting bracket 101. Hydraulic hoses 110 are coupled in the ordinary manner to the control valves 30 and routed through upper boom 15 as in the prior art.

Platform bracket 101 also includes an upper open area for the passage of hydraulic hoses 110, 101. As described above, the interface between platform bracket 101 and platform 104 utilizes two upper platform pins 105 that can be easily removed to allow the platform 104 to pivot on the lower platform pin 106 and tilt down, thus allowing water and debris to be removed from the platform 104 and allowing maintenance access to the control valves 30.

As will become apparent to those of ordinary skill, the foregoing design features provide an array of advantages over prior art aerial technology. First, with respect to insulation, because the resin used in the manufacture of the composite materials and components is non-conductive, all of the components constructed from such material enhance the electrical safety of the entire assembly. In terms of weight, using actual data acquired by the inventors in prototypes, the mounting bracket 101 represents a 30% reduction in weight versus the prior bracket 26 and platform covers 32. Similarly, the platform shaft retaining assembly 100 represents a weight reduction of at least ten pounds where the upper boom 15 is not required to cover the new platform shaft retaining assembly 100. Furthermore, the composite platform mounting pins 105 and 106 weigh approximately 40% less than the pull-pin bucket attachment used in the prior design.

Structural integrity of the aforementioned components which employ the three-dimensional weave and braid perform fabrics has also been substantially enhanced, as evidenced by finite element analysis conducted by the inventors. Specifically, structural members are much less prone to catastrophic failure, because such members are more likely to splinter at the surfaces while the bulk of the member remains largely intact and capable of supporting loads far in excess of typical operating conditions. Also, inter-part compatibility is greatly improved, particularly in the shaft 102, because the desired characteristics of the composite materials can still be obtained while using a steel or aluminum cylinder 136 to mate with the leveling system sprocket 29 and remain supported by the bearings 27.

Finally, the total costs of manufacturing the assembly can be reduced, and the ease of manufacture can be increased, because there is a corresponding decrease in required fabrication of the composite material parts. Importantly, these trends are expected to improve as the number of assemblies manufactured increases over time.

Although exemplary embodiments of the present invention have been shown and described, many changes, modifications, and substitutions may be made by one having ordinary skill in the art without necessarily departing from the spirit and scope of the invention. For example, the present invention is not strictly limited to use with articulating or telescoping aerial devices such as those described herein. Any apparatus requiring the positioning of an operator within an electrically insulated platform could be improved by the addition of the aerial work platform assembly using composite materials as claimed, such as in the case of digger derricks. Also, it should be understood that any single component fabricated by a fiber-reinforced resin, and which meets required structural criteria, would provide benefits to the entire boom assembly and is within the scope of this invention. Similarly, it should be understood that each or any of the aforementioned components, such as (by example only and not as an exhaustive list) the platform shaft retaining assembly 100, the mounting bracket 101, or the platform 104 may be constructed from different specifications of fabric and resin, depending upon the operating conditions to which they may be subjected.

We claim:

1. An aerial work platform assembly, comprising:

a) a platform shaft retaining assembly;

b) a mounting bracket connected to said platform shaft retaining assembly; and c) a platform connected to said mounting bracket;

wherein said platform shaft retaining assembly includes two concentric apertures for installation of a pivot shaft therein;

the mounting bracket having an upper gusset member and a center gusset member that are bonded together and that include horizontal portions to which the pivot shaft is bonded;

upper and lower platform pins;

a valve bracket;

a platform bracket;

and upper platform pins that provide for pivoting on a lower platform pin and tilting down of the platform thereby, and wherein the platform shaft assembly, the mounting bracket, the upper and lower platform pins, the valve bracket, and the mounting bracket are constructed in a redesigned manner and are non-conductive and constructed from a three-dimensional integrally and unitarily formed orthogonal woven, multiaxial, or braided preform infused with resin to form a composite material that resists delamination comprising a first fabric-reinforced resin, and wherein the aerial platform assembly is insulated and non-conductive and includes substantially no metal components, wherein the preform is unitarily and integrally constructed by three (3) independent, interlacing, non-crimped yarn systems, the preform providing for no delamination of the composite formed therefrom.

2. The assembly of claim 1, wherein said mounting bracket is non-conductive and is constructed from a second fabric-reinforced resin.

3. The assembly of claim 1, wherein said platform is non-conductive and is constructed from a third fabric-reinforced resin.

4. The assembly of claim 1, wherein said fabric-reinforced resin includes a preform fabric having a conformable three-dimensional weave.

5. The assembly of claim 1, wherein said resin is a dielectric resin selected from the group consisting of epoxy, epoxy vinyl ester, vinyl ester, polyester, and phenolic.

6. An aerial work platform assembly, comprising:

a) a platform shaft retaining assembly that includes two concentric apertures for installation of a pivot shaft therein;

b) a mounting bracket connected to said platform shaft retaining assembly; and c) a platform connected to said mounting bracket;

wherein the mounting bracket further includes an upper gusset member and a center gusset member that are bonded together and that include horizontal portions to which the pivot shaft is bonded;

upper and lower platform pins;

a valve bracket;

a platform bracket;

and upper platform pins that provide for pivoting on a lower platform pin and tilting down of the platform thereby, and wherein the platform shaft assembly, the mounting bracket, the upper and lower platform pins, the valve bracket, and the mounting bracket are constructed in a redesigned manner, and are non-conductive and constructed from a composite material comprising a first fabric-reinforced resin and include substantially no metal components, and wherein the aerial work platform assembly is completely insulated and non-conductive, the first fabric-reinforced resin including a preform fabric that is unitarily and integrally constructed by three (3) independent, interlacing, non-crimped yarn systems that provide for no delamination of the composite formed therefrom.

7. The assembly of claim 6, wherein said mounting bracket is non-conductive and is constructed from a second fabric-reinforced resin.

8. The assembly of claim 6, wherein said platform is non-conductive and is constructed from a third fabric-reinforced resin.

9. The assembly of claim 6, wherein said resin is a dielectric resin selected from the group consisting of epoxy, epoxy vinyl ester, vinyl ester, polyester, and phenolic.

10. An aerial work platform assembly, comprising:

a) a platform shaft retaining assembly;

b) a mounting bracket connected to said platform shaft retaining assembly; and c) a platform connected to said mounting bracket;

wherein said platform shaft retaining assembly is non-conductive and includes substantially no metal components and is constructed from a composite material formed from a non-random fiber matrix that resists delamination, the composite material comprising a first fabric-reinforced resin, and wherein the aerial work platform assembly is completely insulated and non-conductive; the fabric-reinforced resin having a conformable three-dimensional construction, wherein the preform fabric is unitarily and integrally constructed by three (3) independent, interlacing, non-crimped yarn systems, the preform providing for no delamination of the composite formed therefrom.

11. The assembly of claim 10, wherein said platform shaft retaining assembly is non-conductive and is constructed from a second fabric-reinforced resin.

12. The assembly of claim 10, wherein said mounting bracket is non-conductive and is constructed from a third fabric-reinforced resin.

13. The assembly of claim 10, wherein said resin is a dielectric resin selected from the group consisting of epoxy, epoxy vinyl ester, vinyl ester, polyester, and phenolic.

14. An aerial work platform assembly including composite components for providing a lightweight, strong structure that is non-conductive, the composite components consisting essentially of:

a platform shaft retaining assembly including two concentric apertures for installation of a pivot shaft therefrom;

a platform mounting bracket having an upper gusset member and a center gusset member that are bonded together and that include horizontal portions to which the pivot shaft is bonded;

upper and lower platform pins;

a valve bracket;

and upper platform pins that provide for pivoting on the lower platform pin and tilting down of the platform thereby, wherein these components are formed of non-conductive composite materials, including 3-D woven preforms that are unitarily and integrally formed and later infused with resin to form the composite materials, wherein the preform are unitarily and integrally constructed by three (3) independent, interlacing, non-crimped yarn systems, the preform providing for no delamination of the composite formed therefrom, and wherein these components do not include metal or conductive material.

* * * * *